United States Patent [19]

Mead

[11] Patent Number: 4,924,954

[45] Date of Patent: May 15, 1990

[54] BIT BREAKOUT SYSTEM

[76] Inventor: Raymond A. Mead, 1596 Kingsbury, Casper, Wyo. 82609

[21] Appl. No.: 380,623

[22] Filed: Jul. 14, 1989

[51] Int. Cl.[5] ..... E21B 19/18

[52] U.S. Cl. ..... 175/315; 166/85; 166/77.5; 81/57.34; 81/57.35; 173/164

[58] Field of Search ..... 166/77.5, 85, 379; 175/85, 315; 173/164; 81/57.16, 57.34, 57.35

[56] References Cited

U.S. PATENT DOCUMENTS

| | | | |
|---|---|---|---|
| 1,044,349 | 11/1912 | Chapman | 173/164 |
| 1,449,581 | 3/1923 | Brewster | 173/164 |
| 1,445,142 | 5/1923 | Loyd . | |
| 1,506,583 | 8/1924 | Hoffman . | |
| 2,054,223 | 9/1936 | Le Bus . | |
| 2,719,025 | 9/1955 | Stone . | |
| 3,195,640 | 7/1965 | Wilde . | |
| 3,239,016 | 3/1966 | Alexander . | |
| 3,446,284 | 5/1969 | Dyer et al. . | |
| 3,463,247 | 8/1969 | Klein . | |
| 3,554,298 | 8/1969 | Klein . | |
| 3,552,506 | 1/1971 | Mayer . | |
| 3,739,434 | 6/1973 | Wheeler . | |
| 3,762,578 | 10/1973 | Cooper et al. | 175/85 |
| 3,768,579 | 10/1973 | Klein . | |
| 3,944,300 | 3/1976 | Learmont et al. | 173/164 |
| 3,980,143 | 9/1976 | Swartz et al. | 166/77.5 |
| 4,030,542 | 6/1977 | Poe et al. | 173/164 |
| 4,057,887 | 11/1977 | Jones et al. . | |
| 4,352,399 | 10/1982 | Davis . | |
| 4,410,044 | 10/1983 | Naffziger . | |
| 4,475,604 | 10/1984 | Albertson et al. | 173/164 |
| 4,495,840 | 1/1985 | Freitag et al. . | |
| 4,844,171 | 7/1989 | Russell, Jr. | 166/77.5 |

*Primary Examiner*—Bruce M. Kisliuk

*Attorney, Agent, or Firm*—Dean P. Edmundson

[57] ABSTRACT

A system for securing a drill bit against rotation in a drilling rig of the type having a rotary table with an opening which is smaller than the drill bit. A breaker plate is supported in a frame below the rotary table. The breaker plate includes an irregularly shaped opening for engaging the drill bit when the drill string is raised. A sub is connected between the bit and the drill string. The sub can be rotated by the rotary table when the bit is held by the breaker plate to attach or detach the bit.

14 Claims, 3 Drawing Sheets

BIT BREAKOUT SYSTEM

FIELD OF THE INVENTION

This invention relates to apparatus and techniques used in the drilling or boring of wells. More particularly, this invention relates to apparatus and techniques for connecting and disconnecting drill bits to and from the lower end of a drill string.

BACKGROUND OF THE INVENTION

In conventional drilling or boring of wells a drill string comprises a plurality of drill pipe sections coupled together with a drill bit secured to the lower end of the string. As additional drill pipe sections are to be added to the length of the drill string, the uppermost pipe section in the string is held stationary while the additional section of drill pipe is rotated and threadably secured to the uppermost section.

Typically this procedure involves the use of a rotary table which is supported in a horizontal plane. The drill pipe passes through an opening in the center of the rotary table.

To uncouple the drill pipe sections a reverse procedure is used. As the drill string is raised out of the bore hole individual drill pipe sections are unthreaded and removed. The drill bit is then detached from the lowest drill pipe section.

In conventional drilling rigs used for wells deeper than about 3000 feet the rotary table is very large. The opening in the center of the rotary table is sufficiently large that the drill bit on the lower end of the drill string is able to pass through the opening.

However, in conventional truck-mounted drilling rigs used for shallow wells (e.g., water wells or oil wells less than about 3000 feet deep), the opening in the rotary table is too small to allow the drill bit to pass through it. Thus, it is necessary to attach or detach the drill bit to or from the lower end of the drill string, respectively, at a point below the rotary table. Normally in this situation the drill bit must be attached, or detached, manually using long pipe wrenches. This is very much labor-consuming and also potentially dangerous.

There have previously been proposed various techniques and apparatus for connecting and disconnecting drill pipe sections in the field. See, for example, U.S. Pat. Nos. 3,239,016; 3,446,284; 3,463,247; 3,552,506; 3,554,298; 3,768,579; 4,057,887; 4,352,399; and 4,495,840. None of such apparatus, however, is suitable for use with a small truck-mounted drilling rig where the opening in the rotary table is smaller than the drill bit.

Rotary tables and other related drilling apparatus are described, for example, in U.S. Pat. Nos. 1,455,142; 1,506,583; 2,054,223; 2,719,025; 3,195,640; 3,739,434; and 4,410,044. However, none of such patents describe apparatus or techniques for safely attaching or detaching, a drill bit to the lower end of a drill string in a small truck- mounted drilling rig.

There has not heretofore been provided apparatus or techniques for solving the problems noted above.

SUMMARY OF THE PRESENT INVENTION

In accordance with the present invention there are provided apparatus and technique for safely, quickly, and efficiently attaching, or detaching, a drill bit to the lower end of a drill string in a truck-mounted drilling rig of the type in which the opening in the rotary table is smaller than the drill bit.

In one embodiment the invention comprises an improvement for use in a drilling rig of the type having a rotary table with an opening in it which is smaller than the drill bit, wherein the improvement comprises:

(a) a breaker plate having front, rear, and side edges and an irregularly-shaped (i.e. non-circular) central opening therethrough;

(b) frame means adapted to support the breaker plate below the rotary table; and (c) a sub member having upper and lower ends; wherein the lower end is adapted to be connected to the drill bit and the upper end is adapted to be connected to the drill string.

The breaker plate includes a slot extending between the front edge and the central opening so that the plate can be placed into the frame means even when the drill string is being used. When the breaker plate is supported at its edges in the frame, the drill string passes through the central opening in the breaker plate.

When the drill string is raised the drill bit engages the irregularly-shaped central opening in the breaker plate and is rotationally secured. At the same time the sub member engages the rotary table. Rotation of the sub member by the rotary table will then cause the drill bit to be unthreaded from, or threaded onto, the lower end of the sub.

Similarly, the drill bit can be attached to the lower end of a sub by setting the bit on the ground or other support surface and rotating the sub enough relative to the bit to initiate threaded attachment. Then the drill string and sub are raised until the drill bit engages the irregularly-shaped central opening in the breaker plate, after which further rotation of the sub tightens the bit onto the sub quickly and efficiently.

Several breaker plates, each having a different sized irregularly-shaped central opening therein, may be used in order to accommodate different sizes of drill bits. Also, different sizes and styles of sub members may be used, as desired.

Other advantages of the apparatus of this invention will be apparent from the following detailed description of the accompanying drawings.

BRIEF DESCRIPTION OF THE DRAWINGS

The invention is described in more detail hereinafter with reference to the accompanying drawings, wherein like reference characters refer to the same parts throughout the several views and in which.

DETAILED DESCRIPTION OF THE INVENTION

Figure 1:
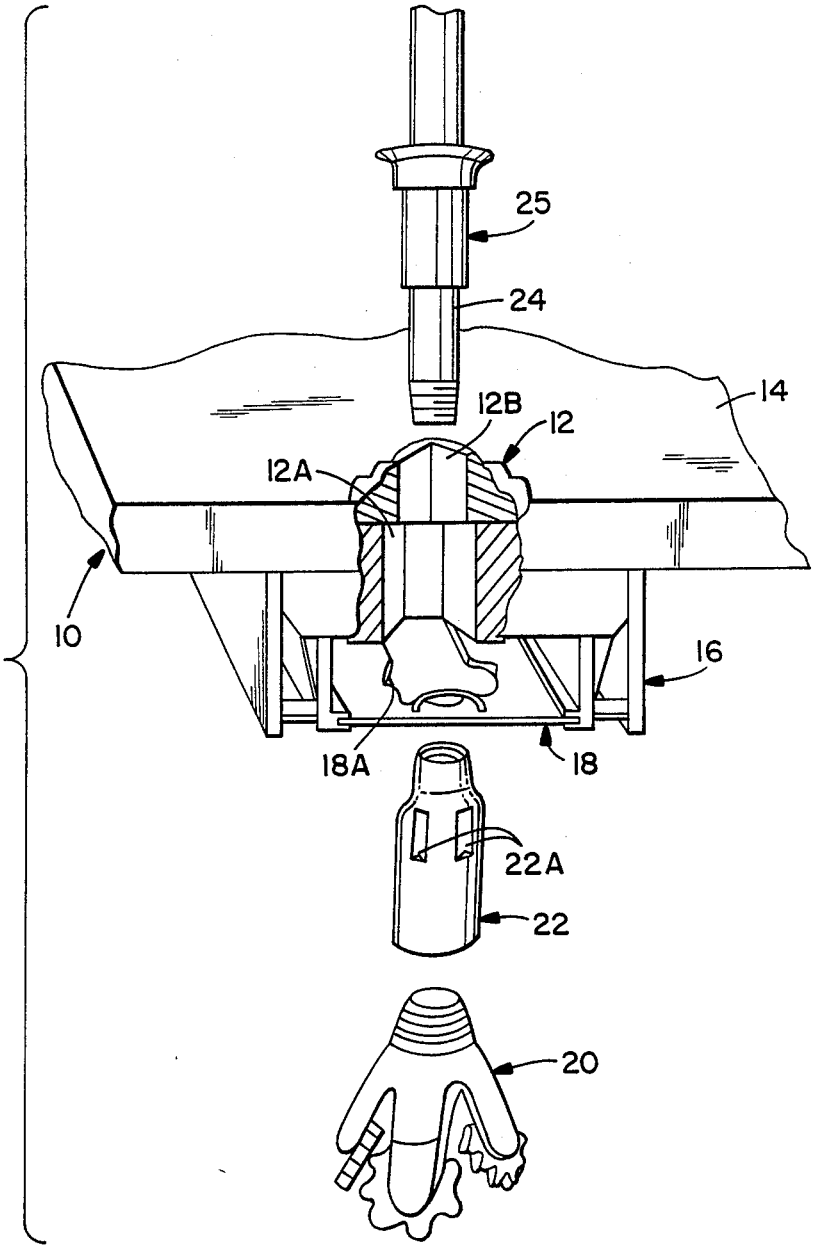
FIG. 1 is a perspective view, partially cut-away, illustrating the system of the invention on a conventional truck-mounted drilling rig.
Figure 2:
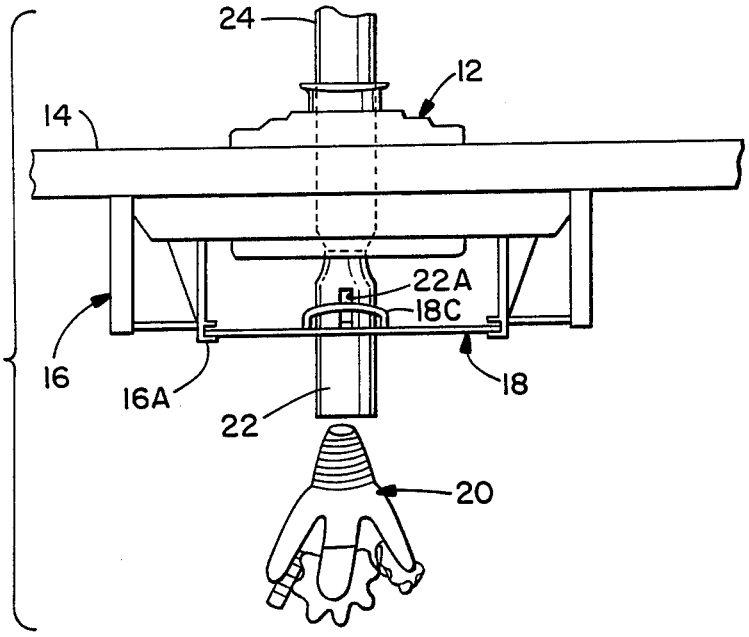
FIG. 2 is a rear elevational view illustrating one embodiment of the system.
Figure 4:
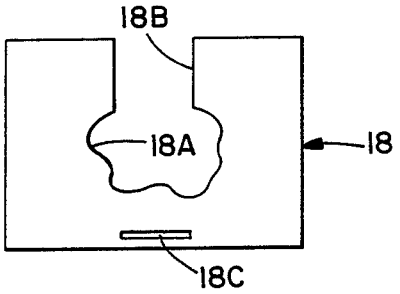
FIG. 4 is a top view of a breaker plate which is useful in the present invention.

In the drawings there is illustrated the bit breakout system of the invention for use on the back of a drilling rig 10 of the type mounted on a truck. The drilling rig includes a conventional rotary table 12 supported in a platform 14 on the drilling rig. The rotary table includes an opening extending vertically therethrough, as illustrated.

A frame 16 extends below the platform. A breaker plate 18 is supported in a horizontal plane below the rotary table. The breaker plate is adapted to be slidingly received at its opposite side edges in channels in the frame 16.

Figure 3:
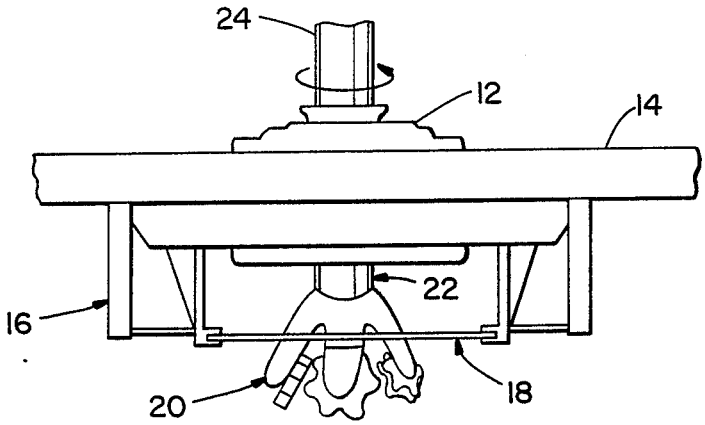
FIG. 3 is a rear elevational view illustrating the manner in which the system operates to loosen a drill bit from the lower end of a sub member.

The breaker plate 18 includes an irregularly-shaped (i.e. non-circular) central opening 18A therein which is adapted to engage the drilling bit 20 when the bit is carried on the lower end of a drill string and the drill string is raised. This is illustrated in FIG. 3. Then when the string 24 is rotated in the direction of the arrow (while the drill bit is prevented from rotating by breaker plate 18) the drill bit is unthreaded from the lower end of the drill string. This is done quickly and efficiently.

A sub member 22 is threaded onto the lower end of the drill string 24 and then the drill bit is threaded onto the lower end of the sub. In other words, both the upper and lower ends of the sub member are threaded.

The rotary table 12 is shown partially cut-away in FIG. 1. The opening 12A which extends vertically through the rotary table has a non-circular cross-sectional configuration (e.g. it may be polygonal and may have 6, 7 or 8 sides, for example). The upper portion of the opening may be fitted with an insert or quill so as to provide a smaller opening 12B, if desired. This opening may be square, for example. The kelly 25 is engaged by the square opening 12B when the drill string is lowered. The kelly is a conventional means for transmitting rotary motion from the rotary table to the drill string.

The sub 22 includes a portion which is non-circular so that when it is threaded onto the lower end of the drill string 24, and the drill string is raised, the sub 22 is slideably engaged by the rotary table (either by opening 12A or opening 12B, depending upon the size of the sub). For example, sub 22 as illustrated in FIG. 1 includes multiple notches 22A around its periphery. These notches are such that they will allow the sub to slidable engage opening 12B in the upper portion of the rotary table. If the sub has a much larger diameter it may be provided with additional notches in a manner such that it will engage the larger opening 12A in the lower portion of the rotary table. In other words, the sub configuration can be modified so as to match the cross-sectional configuration of the opening in the rotary table so that the rotary table will engage the sub and cause it to be rotated in the desired direction when attaching or detaching a drill bit to the lower end of the sub.

The length of the sub and the mounting position of the breaker plate on the rig are related. When the drill string is raised so that the bit proceeds into the opening in the breaker plate the sub must be at a position such that the sub is engaged by the rotary table. This then allows the rotary table to engage and rotate the sub while the bit is held rotationally secured in the breaker plate. This condition must exist for both attaching and detaching the bit.

In order to thread a drill bit onto the lower end of the drill string, the bit may be placed on the ground under the lower end of the drill string. After the drill string (with attached sub) is rotated sufficiently to begin threading onto the drill bit, the drill string can be raised until the bit engages the opening 18A in breaker plate 18. Then the drill bit is restrained against rotation while the sub is rotated by the rotary table.

The breaker plate is preferably planar, as illustrated. The size and shape of the opening 18A may vary from one breaker plate to another so as to accommodate drill bits of different sizes. A slot 18B extends from the front edge of the plate 18 to the irregularly-shaped central opening 18A. This enables the breaker plate to be slipped into the grooves or channels 16A in the frame even when there is a drill string extending downwardly through the rotary table. A handle 18C on the breaker plate 18 facilitates insertion and removal of the breaker plate in the frame 16.

Using the breakout system of this invention the process of coupling and uncoupling a drill bit on the lower end of a drill string is greatly facilitated. The process is completed much more rapidly, safely, and efficiently than when done in the conventional manner using manual labor. It is also much safer than when using manual labor.

Other variants are possible without departing from the scope of the invention. For example, the type of rotary table used may vary, as desired. Also, the configuration and size of the sub member may also vary so long as it is capable of being engaged by the rotary table for rotary movement when the bit is engaged by the breaker plate.

It is also possible to adjust the position of the breaker plate in a manner such that the drill bit engages the opening in the breaker plate when the sub is engaged by the rotary table. The shape of the opening in the breaker plate may also vary, as desired, so long as it is capable of engaging the drill bit and preventing rotation thereof during coupling or decoupling.

What is claimed is:

1. A system for securing a drill bit against rotation in a drilling rig of the type having a rotary table with an opening therethrough which is smaller than said drill bit; wherein a drill string extends through said opening and is adapted to be rotated by said rotary table; wherein said system comprises:

(a) a breaker plate having front, rear, and side edges and an irregularly-shaped central opening therethrough;

(b) frame means carried by said drilling rig for supporting said breaker plate beneath said rotary table in a manner such that said drill string extends through said central opening of said breaker plate; and (c) a sub member having upper and lower ends, wherein said lower end is adapted to be connected to said drill bit and said upper end is adapted to be connected to said drill string; wherein said sub member is further adapted to be engaged by said rotary table for rotational movement when said drill bit is engaged by said breaker plate;

wherein said breaker plate includes a slot extending between said front edge and said central opening, thereby enabling said breaker plate to be inserted into or removed from said support means when said drill string is supported vertically by said drilling rig; wherein said irregularly-shaped central opening in said breaker plate is adapted to engage said drill bit and secure it against rotation when said drill string is raised to a point where said drill bit extends into said central opening and said sub member is engaged by said rotary table.

2. A system in accordance with claim 1, wherein said breaker plate is planar.

3. A system in accordance with claim 1, wherein said breaker plate is slidingly received in said frame means.

4. A system in accordance with claim 3, wherein said breaker plate further includes a handle to facilitate insertion of said plate into, and removal from, said frame means.

5. A system in accordance with claim 2, wherein said breaker plate is perpendicular to said drill string.

6. A system in accordance with claim 3, wherein said frame means includes channels for receiving said side edges of said breaker plate.

7. A system in accordance with claim 1, wherein said opening in said rotary table is square, and wherein said sub includes a portion which is adapted to slidably engage said square opening.

8. In a drilling rig of the type having a rotary table with an opening therethrough, wherein a drill string extends through said opening and is adapted to be rotated by said rotary table; wherein a drill bit is carried by the lower end of said drill string; and wherein said opening in said rotary table is smaller than said drill bit; the improvement comprising:

(a) a breaker plate having front, rear, and side edges and an irregularly-shaped central opening therethrough;

(b) frame means carried by said drilling rig for supporting said breaker plate beneath said rotary table in a manner such that said drill string extends through said central opening of said breaker plate; and (c) a sub member having upper and lower ends, wherein said lower end is adapted to be connected to said drill bit and said upper end is adapted to be connected to said drill string; wherein said sub member is further adapted to be engaged by said rotary table for rotational movement when said drill bit is engaged by said breaker plate;

wherein said breaker plate includes a slot extending between said front edge and said central opening, thereby enabling said breaker plate to be inserted into or removed from said support means when said drill string is supported vertically by said drilling rig; wherein said irregularly-shaped central opening in said breaker plate is adapted to engage said drill bit and secure it against rotation when said drill string is raised to a point where said drill bit extends into said central opening and said sub member is engaged by said rotary table.

9. The improvement in accordance with claim 8, wherein said breaker plate is planar.

10. The improvement in accordance with claim 8, wherein said breaker plate is slidingly received in said frame means.

11. The improvement in accordance with claim 10, wherein said breaker plate further includes a handle to facilitate insertion of said plate into, and removal from, said frame means.

12. The improvement in accordance with claim 9, wherein said breaker plate is perpendicular to said drill string.

13. The improvement in accordance with claim 10, wherein said frame means includes channels for receiving said side edges of said breaker plate.

14. The improvement in accordance with claim 8, wherein said opening in said rotary table is square, and wherein said sub member includes a portion which is adapted to slidably engage said square opening.

* * * * *